US007828572B1

(12) United States Patent
Liu

(10) Patent No.: US 7,828,572 B1
(45) Date of Patent: Nov. 9, 2010

(54) ELECTRIC SOCKET HAVING MEANS TO LOCK THE BLADES OF INSERTED ELECTRIC PLUG

(75) Inventor: Wei-Ho Liu, Tuncheng (TW)

(73) Assignee: Ta Hsing Electric Wire & Co., Ltd., Taipei (TW)

( * ) Notice: Subject to any disclaimer, the term of this patent is extended or adjusted under 35 U.S.C. 154(b) by 0 days.

(21) Appl. No.: 12/629,148

(22) Filed: Dec. 2, 2009

(51) Int. Cl.
*H01R 11/22* (2006.01)

(52) U.S. Cl. ..... 439/270

(58) Field of Classification Search ..... 439/270, 439/261, 263, 258, 346, 372, 373, 535, 268
See application file for complete search history.

(56) References Cited

U.S. PATENT DOCUMENTS

| | | | | |
|---|---|---|---|---|
| 3,083,345 | A * | 3/1963 | Scheller | 439/291 |
| 5,921,799 | A * | 7/1999 | Forrester | 439/346 |
| 6,428,339 | B1 * | 8/2002 | Davidson et al. | 439/346 |
| 6,619,975 | B2 * | 9/2003 | Bentley et al. | 439/346 |
| 6,676,428 | B2 | 1/2004 | Burton | |
| 7,114,979 | B1 | 10/2006 | Lai | |

FOREIGN PATENT DOCUMENTS

| | | |
|---|---|---|
| TW | M261875 | 4/2005 |

* cited by examiner

*Primary Examiner*—Jean F Duverne
(74) *Attorney, Agent, or Firm*—Guice Patents PLLC

(57) ABSTRACT

An electric socket includes an electrically insulative bottom shell, two metal electrode clamps mounted inside the electrically insulative bottom shell, an electrically insulative top shell covering the electrically insulative bottom shell and having two bottom spacer ribs set between the two metal electrode clamps to keep them apart, and a sliding block slidably coupled to the electrically insulative top shell and movable between a locking position where a bottom protruding block of the sliding block pushes the free end of each spacer rib sideways against the front clamping strips of the metal electrode clamps, thereby causing the metal electrode clamps to be locked to the metal conducting blades of the inserted electric plug and an unlocking position where the bottom protruding block of the sliding block is released from the spacer ribs, thereby unlocking the meal electrode clamps from the metal conducting blades of the inserted electric plug.

8 Claims, 8 Drawing Sheets

ELECTRIC SOCKET HAVING MEANS TO LOCK THE BLADES OF INSERTED ELECTRIC PLUG

BACKGROUND OF THE INVENTION

1. Field of the Invention

The present invention relates to electric sockets and more particularly, to an electric socket having means to lock the blades of inserted electric plug.

2. Description of the Related Art

An electric socket is an important electric connector for the insertion of an electric plug to obtain power supply. Many electric socket patents have been issued. Taiwan Utility Patent No. M261875, issued on Apr. 11, 2005, discloses an electric socket, entitled "Electric Socket Locking Structure", which comprises a housing 1, a socket body 2 and a locking device 3. By means of rotating the knob 31 of the locking device 3 to press the protruding portions 314 of the knob 31 on top blocks 323 of a holding down member 32, protruding blocks 332 of a retaining member 33 that is rotated by the knob 31 are respectively moved over the protruding blocks 324 of the holding down member 32 into a respective groove 322 on the bottom wall of the holding down member 32, allowing an arched face 311 of the knob 31 to force the holding down member 32 downwards. At this time, pressure feet 325 of the holding down member 32 are lowered to force respective bottom grooves 326 thereof into engagement with the metal conducting blades 61 of the inserted electric plug 6. When reversing the knob 31 of the locking device 3, the protruding blocks 332 of the retaining member 33 are moved out of the grooves 322 over the protruding blocks 324 of the holding down member 32, causing the holding down member 32 to be lifted, and therefore the pressure feet 325 of the holding down member 32 are disengaged from the metal conducting blades 61 of the inserted electric plug 6. In an alternate form of the electric socket locking structure, the knob 31 has a bottom screw rod 311' adapted for locking the inserted electric plug. When rotating the knob of the locking device of the electric socket locking structure, the holding down block 32' is moved upwards or downwards between the unlocking position and the locking position. According to this design, the use of the knob 31 requires much device space in vertical direction. The operation control is not simple. Further, forcing the pressure feet 325 of the holding down member 32 to hold down the metal conducting blades 61 of the inserted electric plug 6 affects the plugging and unplugging force of the electric plug, causing the internal conducting metal terminals 4 in the electric socket to be damaged easily. Further, because the conducting metal terminals 4 are shaped like a fork for the contact of the metal conducting blades 61 of the inserted electric plug 6 at right angles. This contact manner produces a high contact resistance, resulting in a temperature rise.

U.S. Pat. No. 6,428,339 discloses an electric socket design, entitled "Lockable electrical cord connector unit". According to this design, the lockable electrical cord connector unit comprises a cylindrical connector housing made of electrically non-conductive material, a locking control ring telescoping over the connector housing and mechanically connected to structure within the connector housing that allows male electrical connector members extending from the housing to be locked into a female electrical socket. The locking ring allows both ends to be locked to mating electrical terminals. However, the operation of this design is inconvenient.

U.S. Pat. No. 6,676,428 discloses an electric socket design, entitled "Securing device for electrical connectors". According to this design, a cylindrical wheel (100) is arranged at the top side of a housing member (22). By means of rotating the cylindrical wheel (100), a screw-style plunger (42) is moved between two prongs (24;26), thereby locking the electric plug. However, using the screw-style plunger to force the prongs affects the application of force to plug/unplug the electric plug. In consequence, the prongs inside the electric socket tend to be damaged, shortening the work life of the electric socket.

U.S. Pat. No. 7,114,979 discloses an electric socket design, entitled "Structure of conductive sheet in socket". According to this design, a conductive sheet in a socket comprises a conductive sheet body having a conductive terminal on the rear end and two parallel conductive pins on the front end with an inserting slot formed therebetween. However, the conductive sheet in a socket is adapted to contact the inserted conductive sheet in the inserted plug at right angles. The limited contact area between the conductive sheet in the socket and the conductive sheet in the plug produces a high contact resistance, resulting in a temperature rise.

SUMMARY OF THE INVENTION

The present invention has been accomplished under the circumstances in view. It is one object of the present invention to provide an electric socket, which can be conveniently operated to lock the inserted electric plug, assuring a high level of safety.

To achieve this and other objects of the present invention, an electric socket is electrically connected with a power cord for the connection of an electric plug having at least two metal conducting blades. The electric socket comprises an electrically insulative bottom shell, the electrically insulative bottom shell having a front wall, a rear wall opposite to the front wall, two insertion slots cut through the front wall for the insertion of the two metal conducting blades of the electric plug respectively, two sidewalls bilaterally connected between the front wall and the rear wall, a bottom wall, an accommodation chamber surrounded by the front wall, the rear wall, the bottom wall and the two side walls, and two rear notches located on the rear wall; two metal electrode clamps mounted in the accommodation chamber inside the electrically insulative bottom shell for receiving the two metal conducting blades of the electric plug respectively, each metal electrode clamp having a base positioned in one rear notch on the rear wall of the electrically insulative bottom shell, two front clamping strips forwardly extended from the base and curved toward each other and then apart from each other and a rear connection portion electrically connected to one of positive pole and negative pole conductors of the power cord; an electrically insulative top shell attached to the electrically insulative bottom shell to close the accommodation chamber, the electrically insulative top shell having two spacer ribs protruded from a bottom wall thereof and set between the two metal electrode clamps to keep the two metal electrode clamps apart and a sliding slot cut through top and bottom walls thereof between the two spacer ribs, each spacer rib having a free end, a big convex portion located on an outer side of the free end and a small convex portion located on an inner side of the free end opposite to the big convex portion, the big convex portion of each spacer rib being stopped against an inner sided front clamping strip of one respective metal electrode clamp to support the associating metal electrode clamp in place for receiving the associating metal conducting blade of the electric plug; and a sliding block coupled to the sliding slot of the electrically insulative top shell and movable forwards and backwards along the sliding slot between a locking position and an unlocking position, the sliding block having a bottom protruding block protruded from a bottom wall thereof and suspending between the two spacer ribs of the electrically insulative top shell. When the sliding block is moved to the locking position, the bottom protruding block pushes the small convex portions of the spacer ribs sideways to force the big convex portions of the spacer ribs against the front clamping strips of the metal electrode clamps, thereby causing the metal electrode clamps to be locked to the metal conducting blades of the electric plug. When the sliding block is moved to the unlocking position, the bottom protruding block is released from the spacer ribs, thereby unlocking the meal electrode clamps from the metal conducting blades of the electric plug.

Thus, the electric socket utilizes the bottom protruding block of the sliding block to move the free ends of the two spacer ribs of the electrically insulative top shell, thereby controlling the front clamping strips of the two metal electrode clamps to clamp the metal conducting blades of the electric plug. When the sliding block is in the unlocking position, the front clamping strips of the two metal electrode clamps give no pressure to the metal conducting blades of the electric plug, allowing removal of the electric plug from the electric socket smoothly without damaging the front clamping strips of the two metal electrode clamps and assuring long-term durability of the electric socket.

Further, the contact between each metal conducting blade of the inserted electric plug and the front clamping strips of the associating metal electrode clamp is a big-area surface contact, the contact resistance between the metal electrode clamp and the metal conducting blades of the inserted electric plug is low, avoiding a temperature rise.

Further, multiple electric sockets may be embedded in a plastic outer shell and electrically connected with a power cord, constituting a safety power strip.

DETAILED DESCRIPTION OF THE PREFERRED EMBODIMENT

Figure 1:
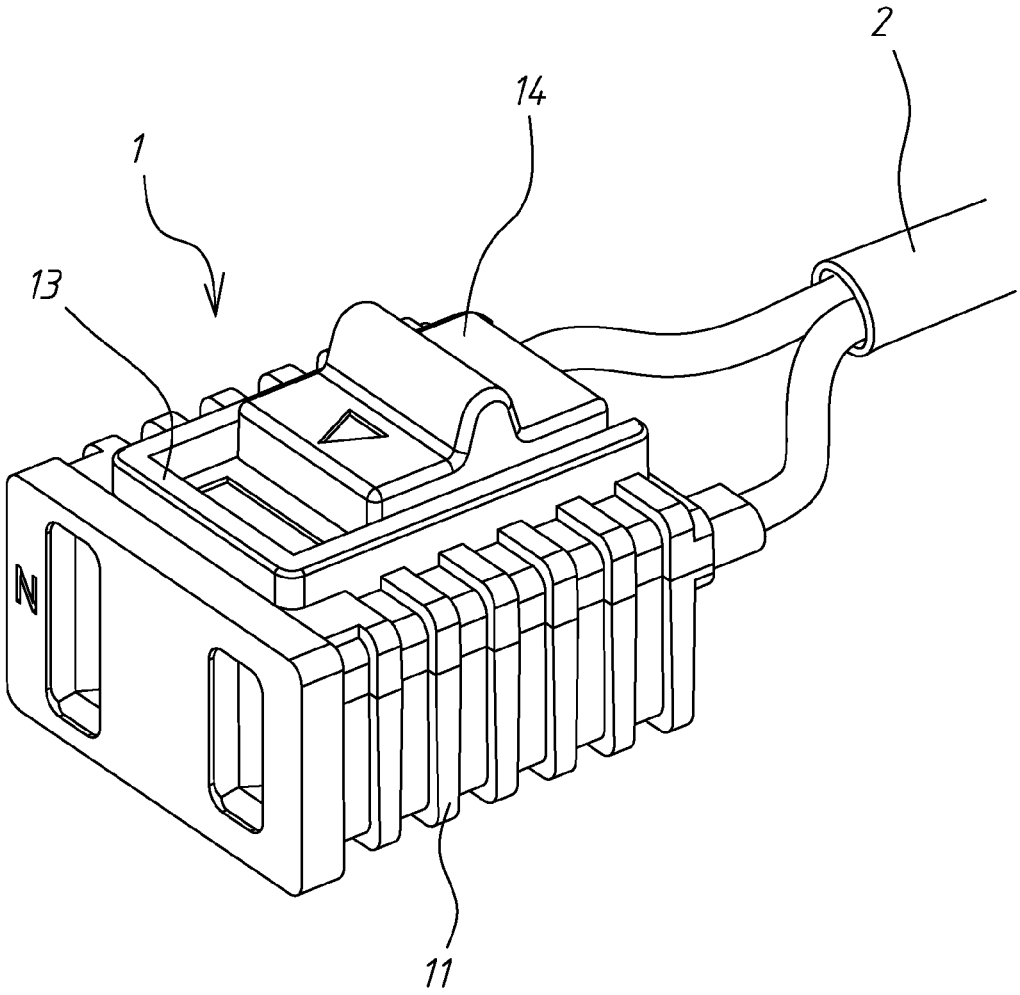
FIG. 1 is an elevational view of an electric socket in accordance with the present invention.
Figure 2:
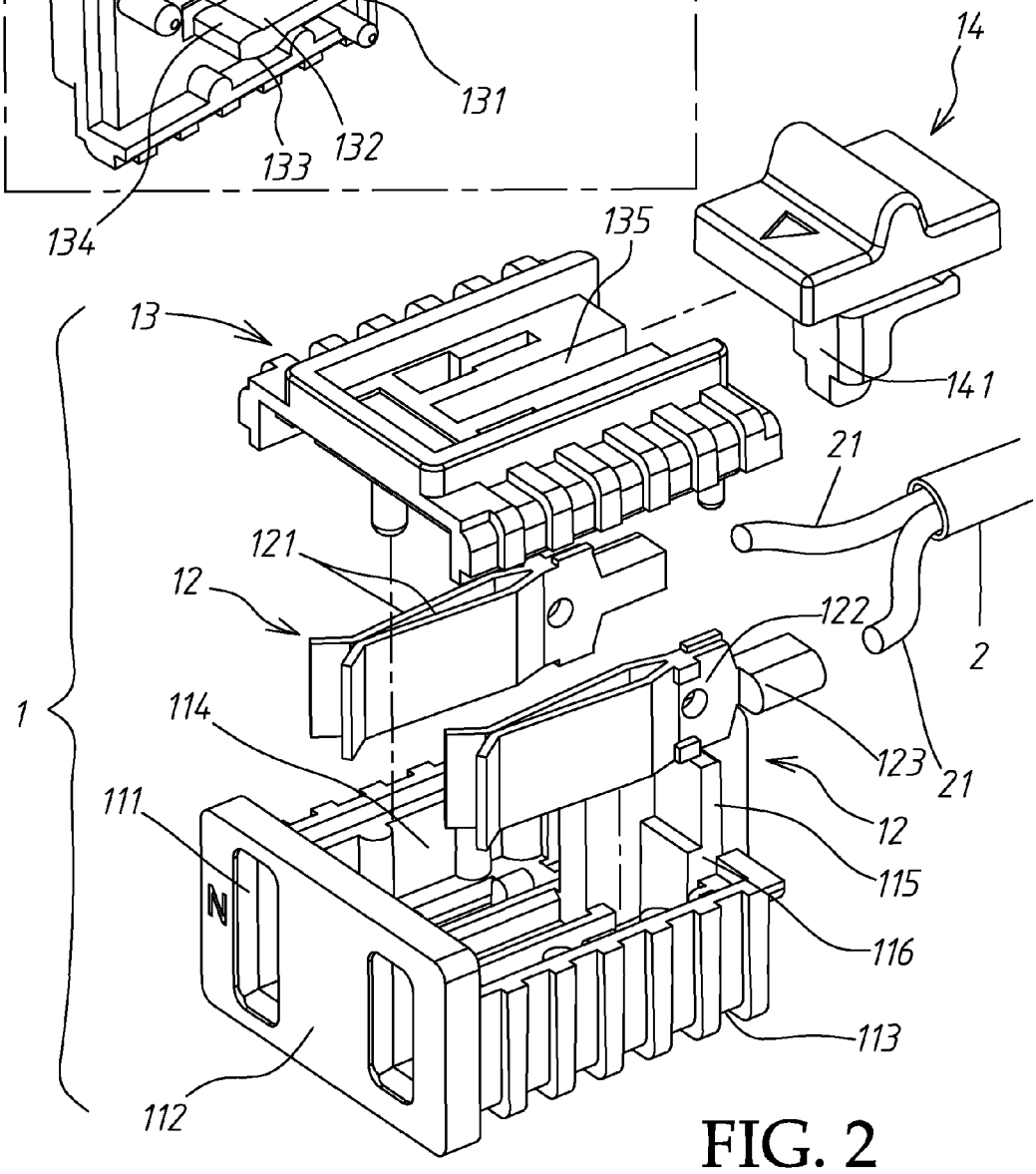
FIG. 2 is an exploded view of the electric socket in accordance with the present invention.

Referring to FIGS. 1 and 2, an electric socket 1 in accordance with the present invention is shown connected to positive pole and negative pole conductors 21 of a power cord 2 for the connection of the metal conducting blades 31 of an electric plug 3 (see also FIG. 7 or FIG. 9) electrically. The electric socket 1 comprises an electrically insulative bottom shell 11, two metal electrode clamps 12, an electrically insulative top shell 13 and a sliding block 14.

The electrically insulative bottom shell 11 has a front wall 112, a rear wall 115 opposite to the front wall 112, two insertion slots 111 cut through the front wall 112 for the insertion of the two metal conducting blades 31 of the electric plug 3 respectively, two sidewalls 113 bilaterally connected between the front wall 112 and the rear wall 115, a bottom wall (not shown), an accommodation chamber 114 surrounded by the front wall 112, the rear wall 115, the bottom wall and the two side walls 113, and two rear notches 116 for the mounting of the two metal electrode clamps 12 respectively.

The metal electrode clamps 12 are mounted inside the electrically insulative bottom shell 11 for receiving the two metal conducting blades 31 of the electric plug 3 respectively, each having a base 122, two front clamping strips 121 forwardly extended from the base 122 and curved toward each other and then apart from each other and a rear connection portion 123 for the connection of one of the positive pole and negative pole conductors 21 of the power cord 2.

Figure 3:
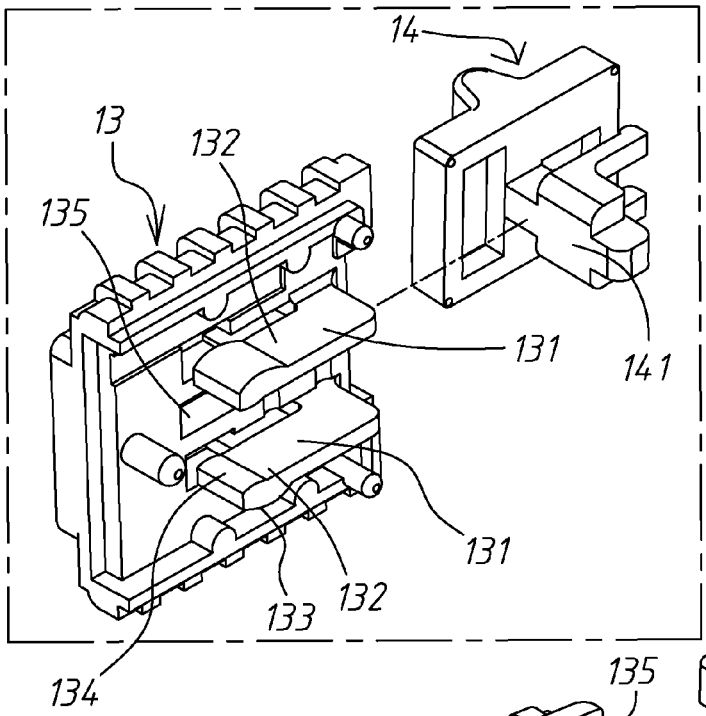
FIG. 3 is an exploded view of a part of the present invention, showing the structure of the electrically insulative top shell and the sliding block.

The electrically insulative top shell 13 is attached to the electrically insulative bottom shell 11 to close the accommodation chamber 114, having two spacer ribs 131 protruded from the bottom wall thereof and set between the two metal electrode clamps 12 to keep the two metal electrode clamps 12 apart and a sliding slot 135 cut through the top and bottom walls thereof between the two spacer ribs 131. As shown in FIG. 3, each spacer rib 131 has a free end 132, a big convex portion 133 located on an outer side of the free end 132 and a small convex portion 134 located on an inner side of the free end 132 opposite to the big convex portion 133. The big convex portion 133 of each spacer rib 131 is stopped against the inner sided front clamping strip 121 of one respective metal electrode clamp 12 to support the associating metal electrode clamp 12 in place for receiving the associating metal conducting blade 31 of the electric plug 3 positively.

The sliding block 14 is slidably coupled to the sliding slot 135 of the electrically insulative top shell 13, having a bottom protruding block 141 protruded from the bottom wall thereof and suspending between the two spacer ribs 131 of the electrically insulative top shell 13. Further, the sliding block 14 can be moved along the sliding slot 135 of the electrically insulative top shell 13 between an unlocking position and a locking position.

Figure 4:
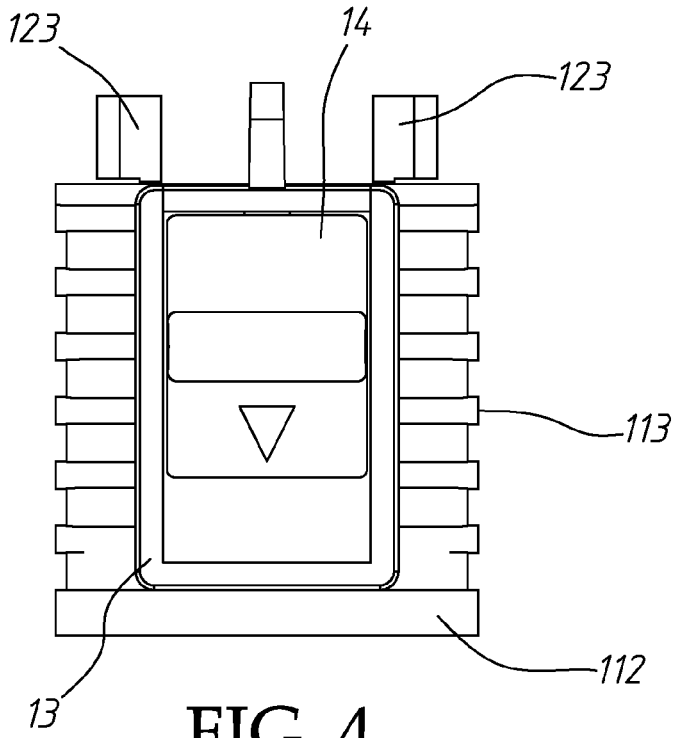
FIG. 4 is a top view of the electric socket in accordance with the present invention.
Figure 5:
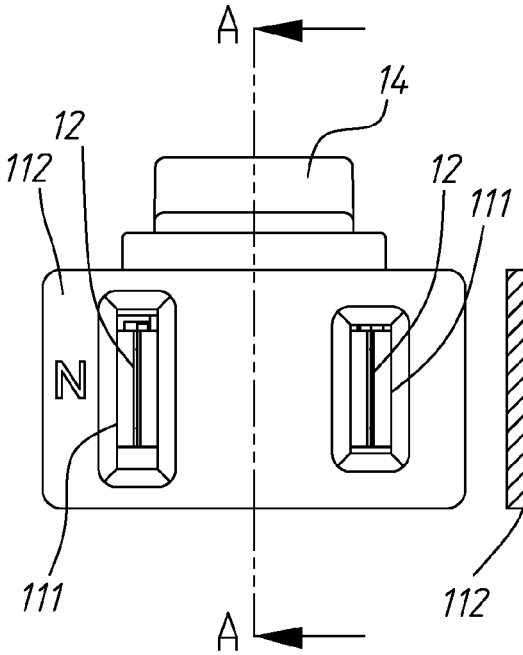
FIG. 5 is a front view of the electric socket in accordance with the present invention.
Figure 6:
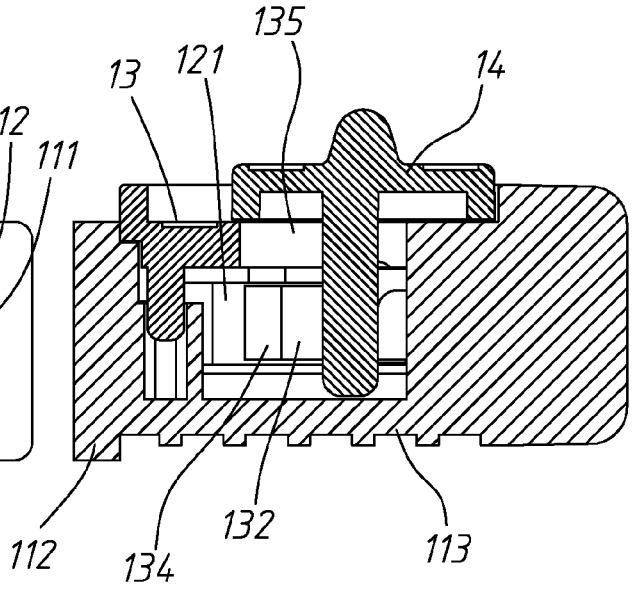
FIG. 6 is a sectional view taken along line A-A of FIG. 5.
Figure 7:
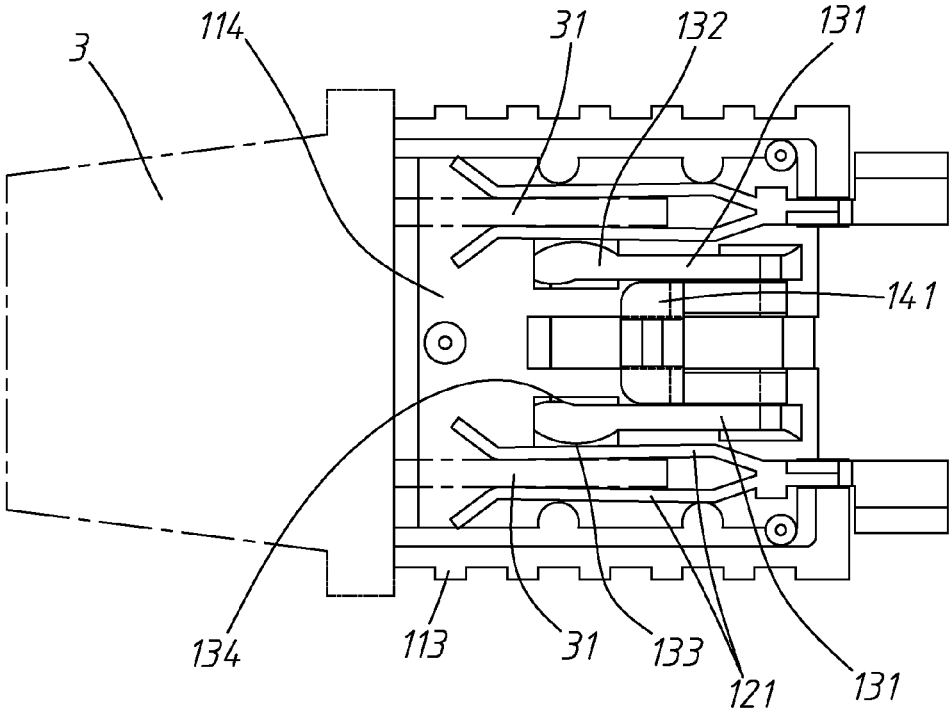
FIG. 7 is a schematic sectional plain view of the present invention after removal of the electrically insulative top shell, showing an electric plug inserted into the electric socket and the sliding block moved to the unlocking position.
Figure 7A:
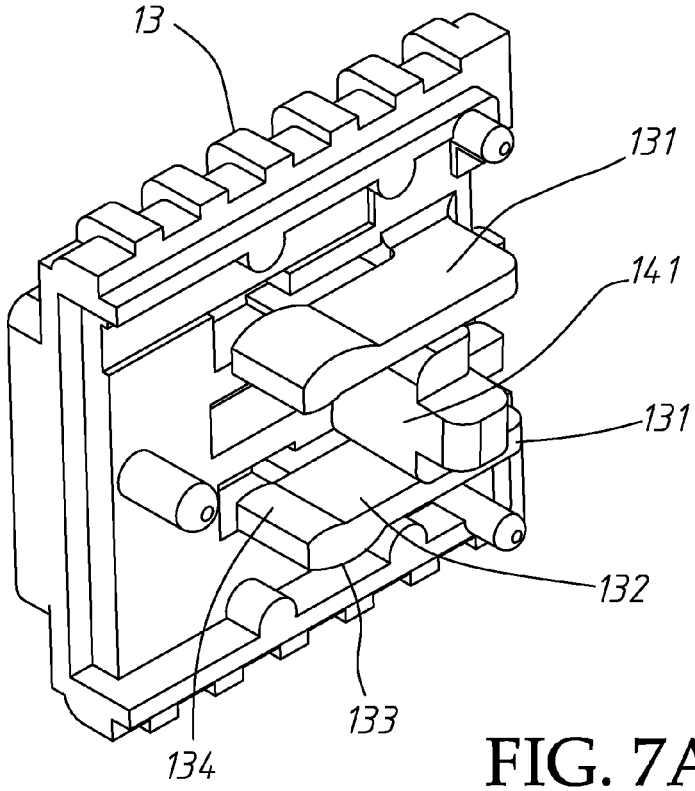
FIG. 7A is an oblique elevation of a part of the present invention, showing the positioning of the sliding block in the electrically insulative top shell in the unlocking position.

Referring to FIGS. 4-6, when the sliding block 14 is moved to the unlocking position, the bottom protruding block 141 suspends between the two spacer ribs 131 of the electrically insulative top shell 13 and is kept apart from the two spacer ribs 131, as shown in FIGS. 7 and 7A, allowing insertion of the metal conducting blades 31 of the electric plug 3 through the insertion slots 111 into the gap between the two front clamping strips 121 of each of the two metal electrode clamps 12 or removal of the metal conducting blades 31 of the electric plug 3 from the front clamping strips 121 of the two metal electrode clamps 12.

Figure 8:
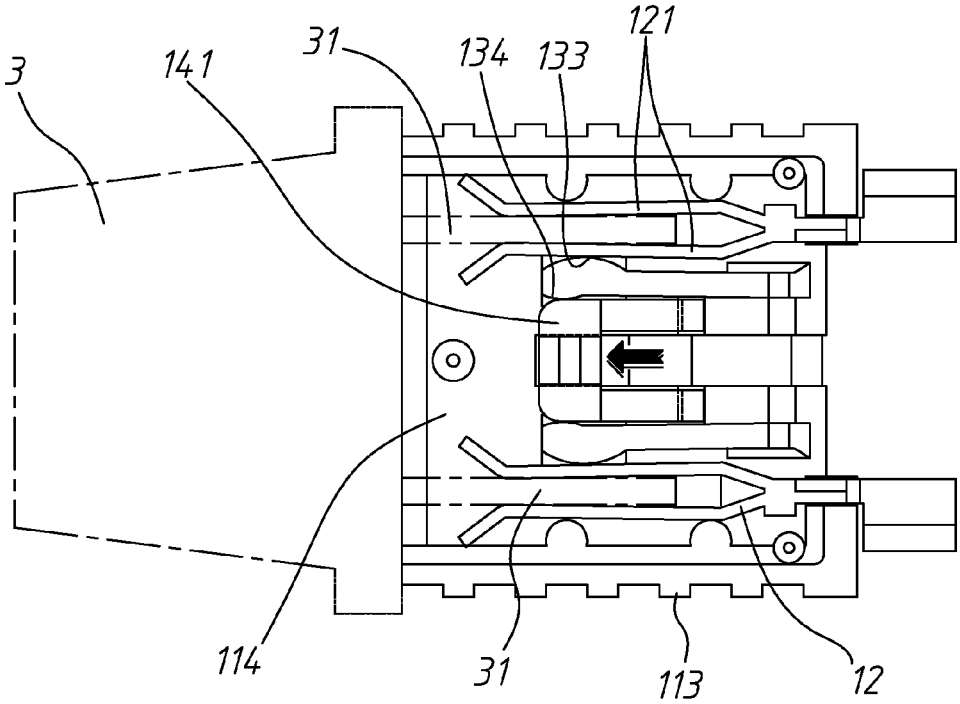
FIG. 8 is a schematic sectional plain view of the present invention after removal of the electrically insulative top shell, showing an electric plug inserted into the electric socket and the sliding block moved to the locking position.
Figure 8A:
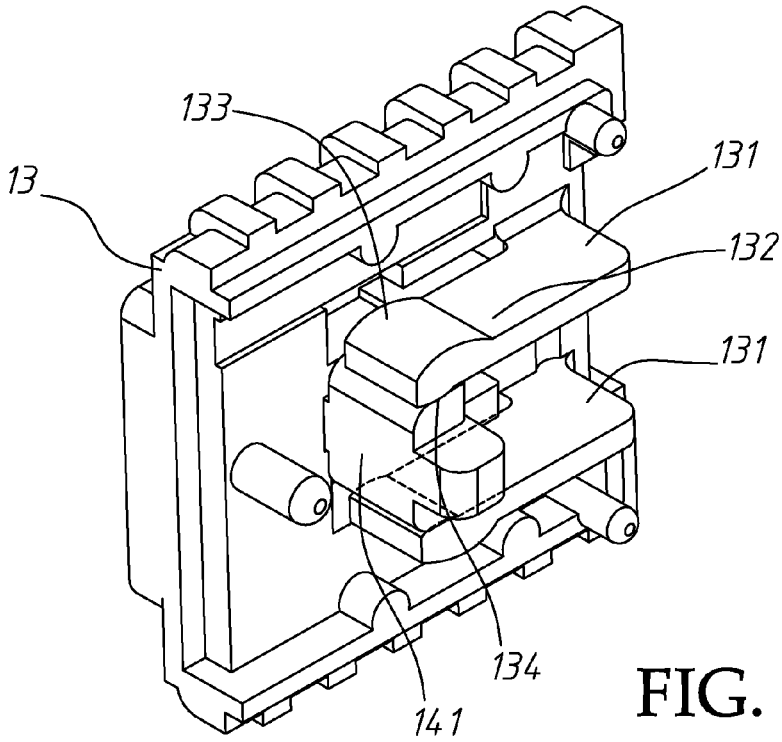
FIG. 8A is an oblique elevation of a part of the present invention, showing the positioning of the sliding block in the electrically insulative top shell in the locking position.

Referring to FIGS. 8 and 8A, when the sliding block 14 is moved to the locking position, the front side of the bottom protruding block 141 pushes the small convex portions 134 of the two spacer ribs 131 sideways, causing the big convex portions 133 of the two spacer ribs 131 to force the adjacent front clamping strips 121 of the two metal electrode clamps 12 against the metal conducting blades 31 of the electric plug 3, and therefore the metal conducting blades 31 of the electric plug 3 are locked to the two metal electrode clamps 12, prohibiting removal of the electric plug 3 from the electric socket 1.

When wishing to remove the electric plug 3 from the electric socket 1, move the sliding block 14 from the locking position to the unlocking position to disengage the bottom protruding block 141 from the two metal electrode clamps 12, as shown in FIG. 7. At this time, the user can remove the electric plug 3 from the electric socket 1.

Figure 9:
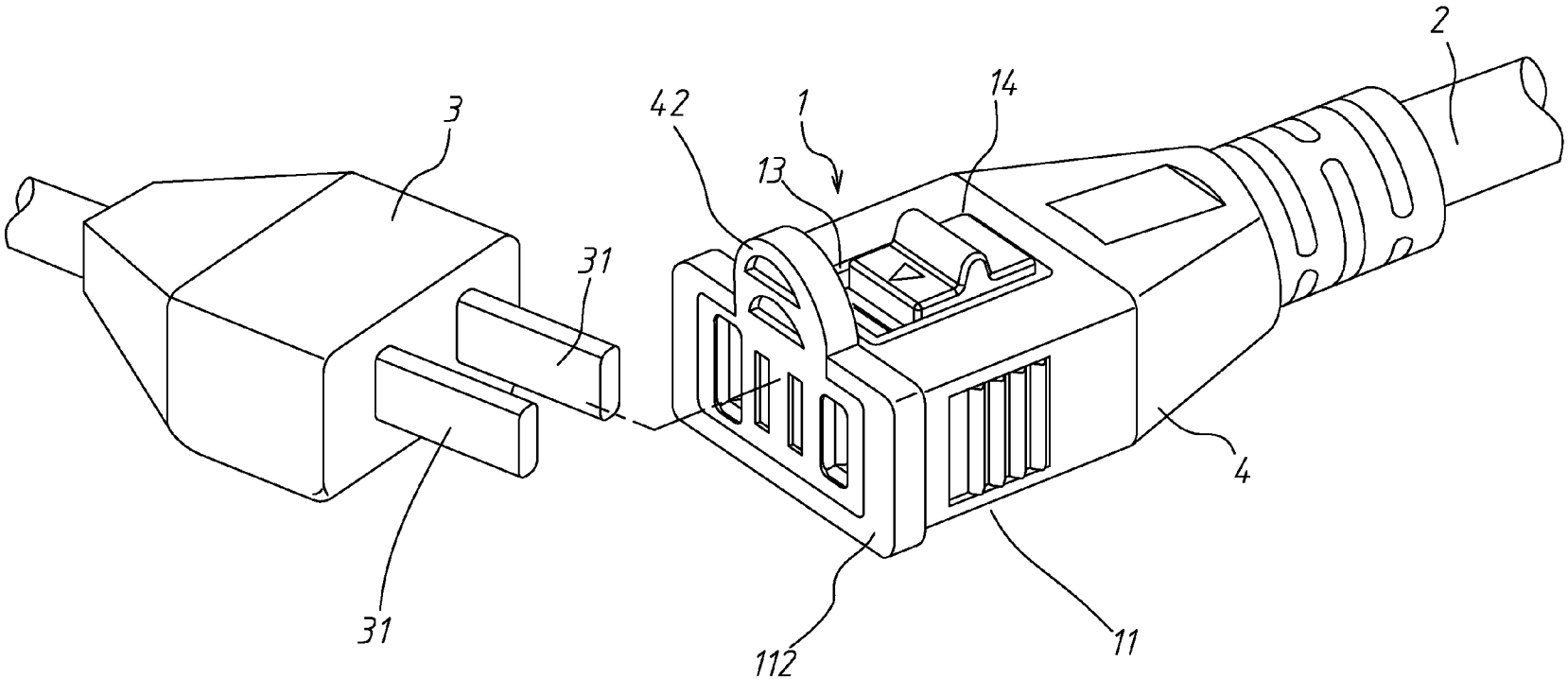
FIG. 9 is an elevational view of an alternate form of the present invention, showing a plastic outer shell (jacket) molded on the electrically insulative bottom shell and a part of the insulation of the power cord and a foolproof stop block disposed at the top side of the front wall of the electrically insulative bottom shell.
Figure 11:
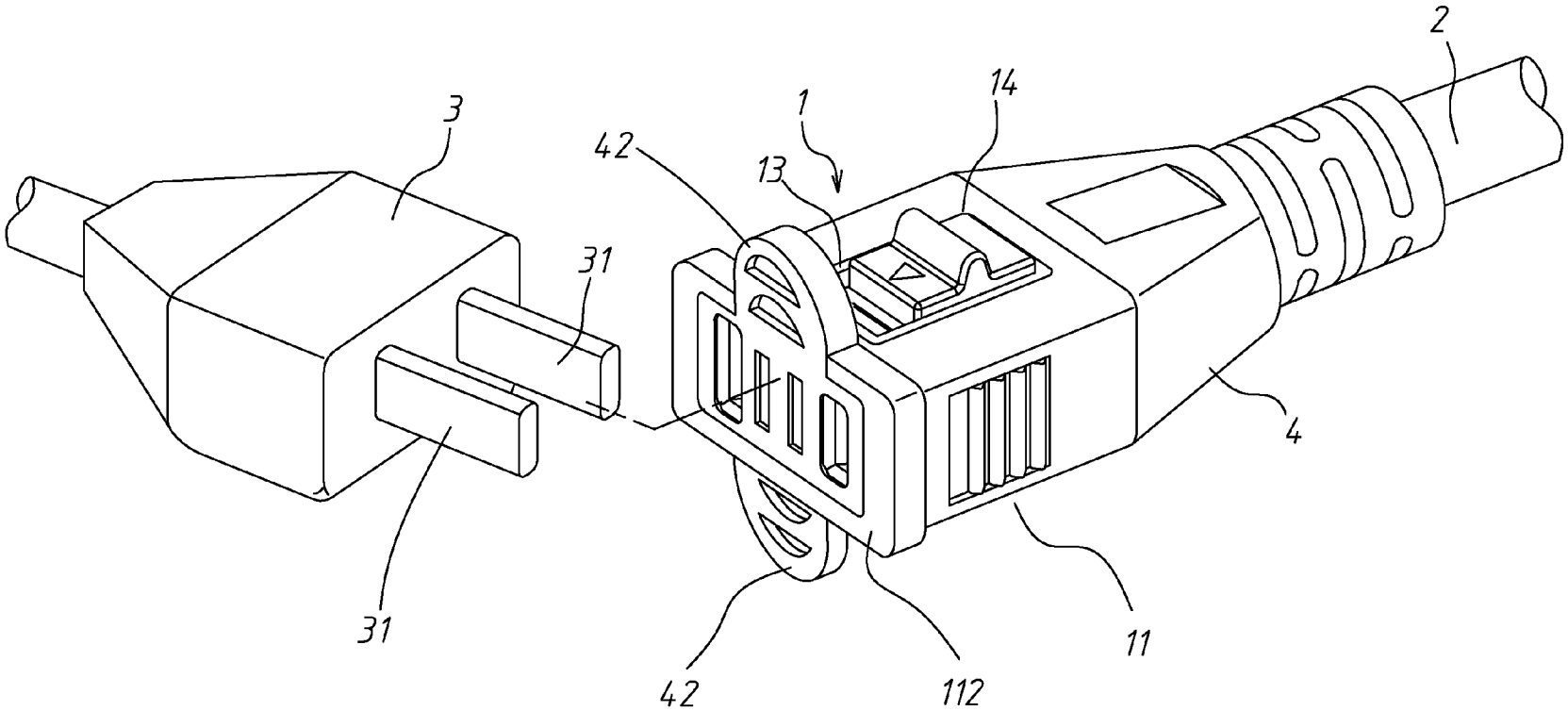
FIG. 11 is an elevational view of still another alternate form of the present invention, showing a plastic outer shell (jacket) molded on the electrically insulative bottom shell and a part of the insulation of the power cord and two foolproof stop blocks respectively disposed at the top and bottom sides of the front wall of the electrically insulative bottom shell.

FIG. 9 shows an alternate form of the present invention. According to this embodiment, the electric socket 1 further comprises a plastic outer shell (jacket) 4 molded on the rear side of the electrically insulative bottom shell 11 and the rear side of the electrically insulative top shell 13 and a part of the insulation of the power cord 2. Further, the plastic outer shell (jacket) 4 can be made having a foolproof stop block 42 at the top side of the front wall of the electrically insulative bottom shell 11 in front of the sliding block 14. The foolproof stop block 42 has a height greater than the height of the sliding block 14. The arrangement of the foolproof stop block 42 avoids error insertion of the electric plug by the user. FIG. 11 shows another alternate form of the present invention. This embodiment is substantially similar to that shown in FIG. 9 with the exception that the plastic outer shell (jacket) 4 has two foolproof stop blocks 42 respectively disposed at the top and bottom sides of the front wall of the electrically insulative bottom shell 11.

As stated above, the electric socket 1 utilizes the bottom protruding block 141 of the sliding block 14 to move the free ends 132 of the two spacer ribs 131 of the electrically insulative top shell 13, thereby controlling the front clamping strips 121 of the two metal electrode clamps 12 to clamp the metal conducting blades 31 of the electric plug 3. When the sliding block 14 is in the unlocking position, the front clamping strips 121 of the two metal electrode clamps 12 give no pressure to the metal conducting blades 31 of the electric plug 3, allowing removal of the electric plug 3 from the electric socket 1 smoothly without damaging the front clamping strips 121 of the two metal electrode clamps 12 and assuring long-term durability of the electric socket 1. Further, the contact between each metal conducting blade 31 of the inserted electric plug 3 and the front clamping strips 121 of the associating metal electrode clamp 12 is a big-area surface contact, the contact resistance between the metal electrode clamp 12 and the metal conducting blades 31 of the inserted electric plug 3 is low, avoiding a temperature rise.

Figure 10:
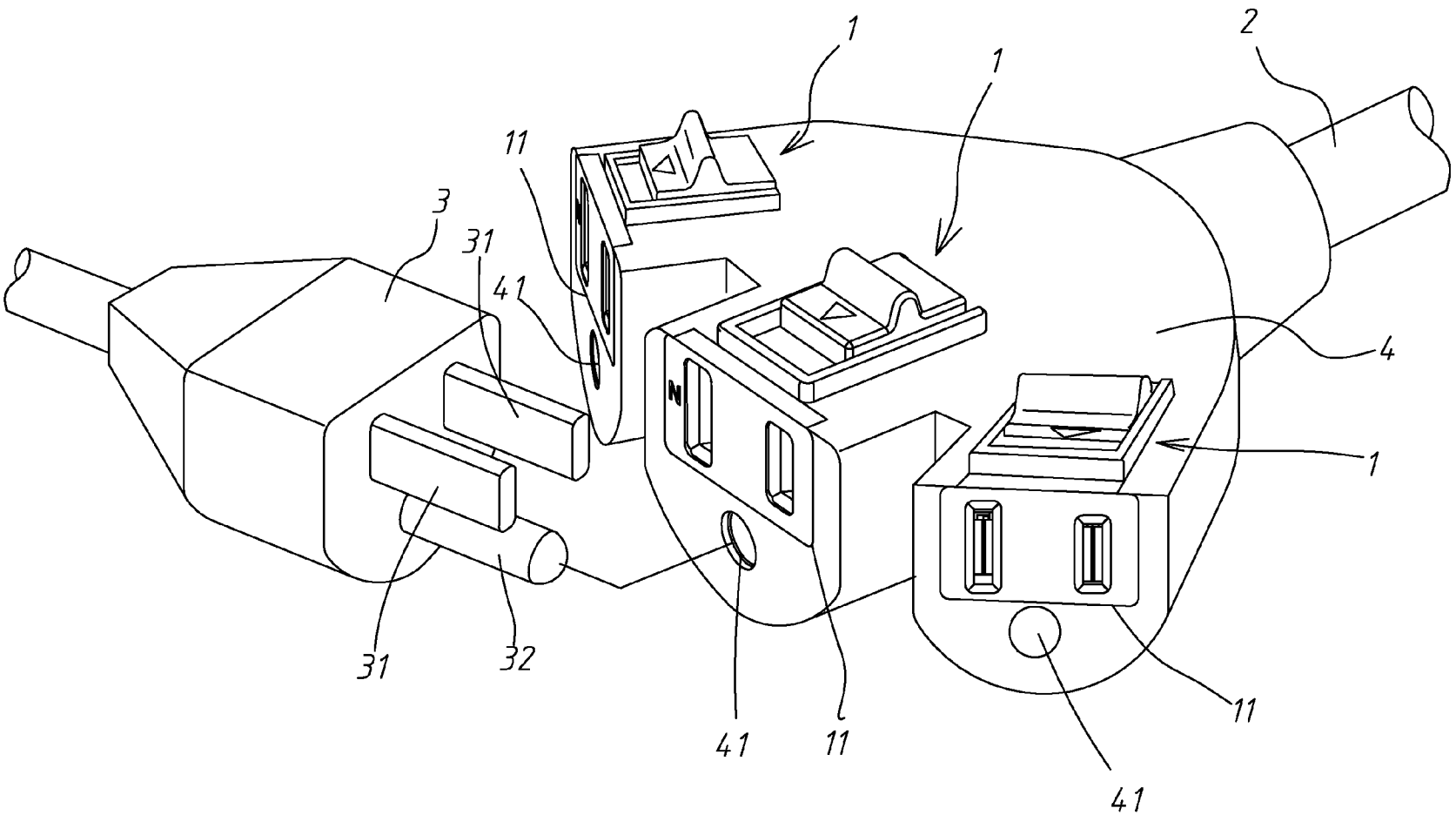
FIG. 10 is a schematic drawing of another alternate form of the present invention, showing multiple electric sockets embedded in a plastic outer shell.

Referring to FIG. 10, multiple electric sockets 1 may be embedded in a plastic outer shell 4 and electrically connected with a power cord 2, constituting a safety power strip. According to the example shown in FIG. 10, 3 electric sockets 1 are embedded in the plastic outer shell 4. The power cord 2 extends out of the rear side of the plastic outer shell 4. The plastic outer shell 4 has a grounding insertion hole 41 disposed beneath the electrically insulative bottom shell 11 of each electric socket 1 for the insertion of the grounding prong 32 of a 3-pin electric plug 3.

A prototype of electric socket has been constructed with the features of FIGS. 1~9. The electric socket functions smoothly to provide all of the features disclosed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electric socket electrically connected with a power cord for the connection of an electric plug having two metal conducting blades, comprising:

an electrically insulative bottom shell, said electrically insulative bottom shell having a front wall, a rear wall opposite to said front wall, two insertion slots cut through said front wall for the insertion of said two metal conducting blades of said electric plug respectively, two sidewalls bilaterally connected between said front wall and said rear wall, a bottom wall, an accommodation chamber surrounded by said front wall, said rear wall, said bottom wall and said two side walls, and two rear notches located on said rear wall;

two metal electrode clamps mounted in said accommodation chamber inside said electrically insulative bottom shell for receiving said two metal conducting blades of said electric plug respectively, each said metal electrode clamp having a base positioned in one said rear notch on said rear wall of said electrically insulative bottom shell, two front clamping strips forwardly extended from said base and curved toward each other and then apart from each other and a rear connection portion electrically connected to one of positive pole and negative pole conductors of said power cord;

an electrically insulative top shell attached to said electrically insulative bottom shell to close said accommodation chamber, said electrically insulative top shell having two spacer ribs protruded from a bottom wall thereof and set between said two metal electrode clamps to keep said two metal electrode clamps apart and a sliding slot cut through top and bottom walls thereof between said two spacer ribs, each said spacer rib having a free end, a big convex portion located on an outer side of said free end and a small convex portion located on an inner side of said free end opposite to said big convex portion, said big convex portion of each said spacer rib being stopped against an inner sided front clamping strip of one respective metal electrode clamp to support the associating metal electrode clamp in place for receiving the associating metal conducting blade of said electric plug; and a sliding block coupled to said sliding slot of said electrically insulative top shell and movable forwards and backwards along said sliding slot between a locking position and an unlocking position, said sliding block having a bottom protruding block protruded from a bottom wall thereof and suspending between said two spacer ribs of said electrically insulative top shell;

wherein when said sliding block is moved to said locking position, said bottom protruding block pushes the small convex portions of said spacer ribs sideways to force the big convex portions of said spacer ribs against the front clamping strips of said metal electrode clamps, thereby causing said metal electrode clamps to be locked to said metal conducting blades of said electric plug; when said sliding block is moved to said unlocking position, said bottom protruding block is released from said spacer ribs, thereby unlocking said meal electrode clamps from said metal conducting blades of said electric plug.

2. The electric socket as claimed in claim 1, further comprising a plastic outer shell surrounding said electrically insulative bottom shell and a part of said power cord.

3. The electric socket as claimed in claim 2, wherein said plastic outer shell has a grounding insertion hole for the insertion of a grounding prong of said electric plug.

4. An electric socket, comprising:

a power cord;

at least one electric socket body electrically connected with said power cord, each said electric socket body comprising:

an electrically insulative bottom shell, said electrically insulative bottom shell having a front wall, a rear wall opposite to said front wall, two insertion slots cut through said front wall for the insertion of two metal conducting blades of an electric plug, two sidewalls bilaterally connected between said front wall and said rear wall, a bottom wall, an accommodation chamber surrounded by said front wall, said rear wall, said bottom wall and said two side walls, and two rear notches located on said rear wall;

two metal electrode clamp mounted inside said electrically insulative bottom shell for receiving the two metal conducting blades of the inserted electric plug respectively, each said metal electrode clamp having a base positioned in one said rear notch on said rear wall of said electrically insulative bottom shell, two front clamping strips forwardly extended from said base and curved toward each other and then apart from each other and a rear connection portion electrically connected to one of positive pole and negative pole conductors of said power cord;

an electrically insulative top shell attached to said electrically insulative bottom shell to close said accommodation chamber, said electrically insulative top shell having two spacer ribs protruded from a bottom wall thereof and set between said two metal electrode clamps to keep said two metal electrode clamps apart and a sliding slot cut through top and bottom walls thereof between said two spacer ribs, each said spacer rib having a free end, a big convex portion located on an outer side of said free end and a small convex portion located on an inner side of said free end opposite to said big convex portion, said big convex portion of each said spacer rib being respectively stopped against an inner sided front clamping strip of one respective metal electrode clamp to support the associating metal electrode clamp in place for receiving the associating metal conducting blade of the inserted electric plug; and a sliding block coupled to said sliding slot of said electrically insulative top shell and movable forwards and backwards along said sliding slot between a locking position and an unlocking position, said sliding block having a bottom protruding block protruded from a bottom wall thereof and suspending between said two spacer ribs of said electrically insulative top shell;

wherein when said sliding block is moved to said locking position, said bottom protruding block pushes the small convex portions of said spacer ribs sideways to force the big convex portions of said spacer ribs against the front clamping strips of said metal electrode clamps, thereby causing said metal electrode clamps to be locked to the metal conducting blades of the inserted electric plug; when said sliding block is moved to said unlocking position, said bottom protruding block is released from said spacer ribs, thereby unlocking said meal electrode clamps from the metal conducting blades of the inserted electric plug; and a plastic outer shell surrounding the electrically insulative bottom shell of each said electric socket body and a part of said power cord.

5. The electric socket as claimed in claim 4, wherein said plastic outer shell has a grounding insertion hole disposed below the electrically insulative bottom shell of each said electric socket body for the insertion of a grounding prong of an electric plug.

6. The electric socket as claimed in claim 5, wherein said plastic outer shell has a foolproof stop block disposed at a top side of the front wall of the electrically insulative bottom shell of each said electric socket body in front of the sliding block of the associating electric socket body, said foolproof stop block having a height greater than the height of the sliding block of the associating electric socket.

7. The electric socket as claimed in claim 5, wherein said plastic outer shell has a plurality of foolproof stop blocks respectively disposed at top and sides of the front wall of the electrically insulative bottom shell of each said electric socket body.

8. The electric socket as claimed in claim 5, wherein the number of said at least one electric socket body is 3; said plastic outer shell has three grounding insertion holes respectively disposed below the electrically insulative bottom shell of each of the three electric socket bodies for the insertion of a grounding prong of an electric plug respectively.

* * * * *